US008991286B2

(12) United States Patent
Davidson et al.

(10) Patent No.: US 8,991,286 B2
(45) **Date of Patent: *Mar. 31, 2015**

(54) COUPLING MECHANISMS FOR DETACHABLE ENGAGING TOOL ATTACHMENTS

(75) Inventors: John B. Davidson, Chicago, IL (US); C. Robert Moon, Joliet, IL (US); George F. Charvat, East Troy, WI (US); Jana T. Charvat, legal representative, East Troy, WI (US)

(73) Assignee: Joda Enterprises, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/209,505

(22) Filed: Aug. 15, 2011

(65) Prior Publication Data

US 2011/0296962 A1 Dec. 8, 2011

Related U.S. Application Data

(63) Continuation of application No. 12/290,638, filed on Oct. 30, 2008, now Pat. No. 8,024,997, which is a continuation of application No. PCT/US2007/008950, filed on Apr. 10, 2007.

(60) Provisional application No. 60/796,382, filed on May 1, 2006.

(51) Int. Cl.
*B25B 23/16* (2006.01)
*B25B 23/00* (2006.01)

(52) U.S. Cl.
CPC ..... *B25B 23/0035* (2013.01)
USPC ..... 81/177.85; 403/324; 403/325

(58) Field of Classification Search
USPC ..... 81/177.85, 177.2, 177.8, 438, 177.7; 279/50, 60, 61; 403/20, 324, 325, 403/322.2, 322.3
See application file for complete search history.

(56) References Cited

U.S. PATENT DOCUMENTS 1,569,117 A * 1/1926 Carpenter ..... 81/124.4
1,864,466 A 6/1932 Peterson (Continued)

FOREIGN PATENT DOCUMENTS

DE 38 04 129 9/1988
EP 1457291 9/2004

(Continued)

OTHER PUBLICATIONS

International Search Report for corresponding International Application No. PCT/US2007/08950 dated Feb. 29, 2008 (2 pages).

(Continued)

*Primary Examiner* — Hadi Shakeri
(74) *Attorney, Agent, or Firm* — Brinks Gilson & Lione; G. Peter Nichols

(57) ABSTRACT

Coupling mechanisms for engaging and releasing a tool attachment such as a socket from a drive element include an engaging element and an actuating element. The actuating element can include a collar or other manually-accessible part, and various features allow for a relatively small outside diameter for the collar or other part. These features include configuring the actuating element to contact the engaging element within the drive element, placing the biasing elements within the drive element, and forming guides for parts of the actuating element within the drive element. Also, the engaging element can move along a direction that is oriented at an oblique angle to the longitudinal axis of the drive element, in whole or in part. The engaging element can have a first part that moves obliquely in the drive element and a second part that moves radially in the drive element to engage the tool attachment.

26 Claims, 4 Drawing Sheets

(56) References Cited

U.S. PATENT DOCUMENTS

| | | | | | |
|---|---|---|---|---|---|
| 1,940,405 | A | * | 12/1933 | Englund | 279/61 |
| 3,011,794 | A | * | 12/1961 | Vaughn | 81/177.85 |
| 3,208,318 | A | | 9/1965 | Roberts | |
| 3,890,051 | A | * | 6/1975 | Biek | 403/20 |
| 4,420,995 | A | | 12/1983 | Roberts | |
| 4,502,365 | A | * | 3/1985 | Hacker | 81/177.85 |
| 4,571,113 | A | | 2/1986 | Coren | |
| 4,614,457 | A | | 9/1986 | Sammon | |
| 4,768,405 | A | | 9/1988 | Nickipuck | |
| 4,770,073 | A | | 9/1988 | Palm | |
| 4,781,085 | A | | 11/1988 | Fox, III | |
| 4,848,196 | A | | 7/1989 | Roberts | |
| 5,214,986 | A | | 6/1993 | Roberts | |
| 5,233,892 | A | | 8/1993 | Roberts | |
| 5,289,745 | A | | 3/1994 | Beardsley | |
| 5,291,809 | A | | 3/1994 | Fox, III et al. | |
| 5,333,523 | A | | 8/1994 | Palm | |
| D355,342 | S | | 2/1995 | Davidson et al. | |
| D359,668 | S | | 6/1995 | Roberts et al. | |
| 5,433,548 | A | | 7/1995 | Roberts et al. | |
| 5,501,125 | A | | 3/1996 | Roberts et al. | |
| 5,644,958 | A | | 7/1997 | Roberts et al. | |
| 5,660,491 | A | | 8/1997 | Roberts et al. | |
| 5,685,208 | A | * | 11/1997 | Tidwell | 81/177.85 |
| D397,597 | S | | 9/1998 | Davidson et al. | |
| 5,833,405 | A | * | 11/1998 | Nielsen | 408/226 |
| 5,851,151 | A | | 12/1998 | Reynolds | |
| 5,911,800 | A | | 6/1999 | Roberts et al. | |
| 6,044,730 | A | | 4/2000 | Roberts et al. | |
| 6,098,500 | A | | 8/2000 | Roberts et al. | |
| 6,109,140 | A | | 8/2000 | Roberts et al. | |
| 6,145,416 | A | | 11/2000 | Bonniot | |
| 6,164,169 | A | | 12/2000 | Goff | |
| 6,182,536 | B1 | | 2/2001 | Roberts et al. | |
| 6,199,457 | B1 | | 3/2001 | Hoff et al. | |
| 6,205,890 | B1 | | 3/2001 | Roberts et al. | |
| 6,755,100 | B1 | | 6/2004 | Chen | |
| 6,823,762 | B2 | * | 11/2004 | Hu | 81/177.85 |
| 6,920,810 | B1 | | 7/2005 | Thompson et al. | |
| 7,111,530 | B2 | * | 9/2006 | Huang | 81/438 |
| 7,398,713 | B2 | | 7/2008 | Davidson | |
| 2004/0126182 | A1 | * | 7/2004 | Lin | 403/322.2 |
| 2004/0146342 | A1 | * | 7/2004 | Lin | 403/324 |
| 2005/0229752 | A1 | | 10/2005 | Nickipuck | |

FOREIGN PATENT DOCUMENTS

| | | | | | |
|---|---|---|---|---|---|
| EP | 1457291 | A1 | * | 9/2004 | B25B 23/00 |
| WO | WO 9002634 | A1 | | 3/1990 | |
| WO | WO 03047817 | | | 6/2003 | |

OTHER PUBLICATIONS

Supplementary European Search Report for Application No. EP07776966 dated Sep. 28, 2009 (three pages).

International Search Report for Application No. PCT/US07/11344 dated Mar. 27, 2008 (two pages).

* cited by examiner

D1
D2

COUPLING MECHANISMS FOR DETACHABLE ENGAGING TOOL ATTACHMENTS

PRIORITY CLAIM

This application is a continuation application of U.S. patent application Ser. No. 12/290,638, filed on Oct. 30, 2008, and issued on Sep. 27, 2011 as U.S. Pat. No. 8,024,997 which is a continuation of PCT/US2007/008950, filed on Apr.10, 2007 and published in English as PCT WO 2007/133360 on Nov. 22, 2007, which claims the benefit of priority from U.S. Application No. 60/796,382 filed on May 1, 2006, the entire contents of each are incorporated herein by reference.

FIELD OF THE INVENTION

The present invention relates to coupling mechanisms for tools and, in particular, to mechanisms for altering engagement forces between a tool and a tool attachment.

BACKGROUND

Torque transmitting tools with a drive element having a drive stud configured for detachable coupling to a tool attachment such as a socket have in the past been provided with mechanisms that allow an operator to select between an engaging position, in which the tool attachment is secured to the drive stud and accidental detachment is substantially prevented, and a releasing position, in which forces tending to retain the tool attachment on the drive stud are reduced or eliminated.

In the tools described in U.S. Pat. No. 5,911,800, assigned to the assignee of the present invention, a releasing spring 50 biases a locking pin 24 upwardly to a release position, while an engaging spring 48 of greater spring force biases the locking pin 24 downwardly to an engaging position (see, for example, FIGS. 1,3, and 4; col. 3, line 66 to col. 4, line 20; col. 4, lines 49-59). By moving a collar 34 away from the drive stud end of the tool, the engaging spring 48 is manually compressed, thereby allowing the releasing spring 50 to move the locking pin 24 to a releasing position.

In the tools described in U.S. Pat. No. 6,755,100 to Alex Chen, a button 50 is pressed by an operator to disengage the end 46 of a latch pin 41 from the tool member 60 to which the tool body was attached (see, for example, col. 3, lines 44 -53; FIGS. 6 and 7). In these tools, the button 50 is accessible only from one specific side of the tool body, which renders access by an operator difficult during certain situations, such as when only one side of the tool is manually accessible.

In the tools described in U.S. Pat. No. 4,768,405 to Michael F. Nickipuck, a sleeve 15 is used to transmit motion to a control bar 14, which in turn acts on a detent located in the drive portion 12 of the tool (see, for example FIGS. 3-4 and 7 -9; col. 4, line 53 to col. 5, line 4). The control bar 14 is positioned in a channel 10 machined into the surface of the tool (FIG. 5, col. 4, lines 42-47).

SUMMARY

By way of introduction, the attached drawings show seven different mechanisms for altering the engagement forces between a drive element and a tool attachment. All of these mechanisms are compact, and they extend only a small distance beyond the outside diameter of the drive element. Certain of these mechanisms use a multiple-part engaging element that includes a first part that is guided for oblique movement with respect to the longitudinal axis of the drive element and a second part within the drive stud that is guided for movement at an angle with respect to the movement of the first part.

The scope of the present invention is defined solely by the appended claims, which are not to be limited to any degree by the statements within this summary or the preceding background discussion.

DETAILED DESCRIPTION OF PREFERRED EMBODIMENTS

Figures 1, 2, 3:
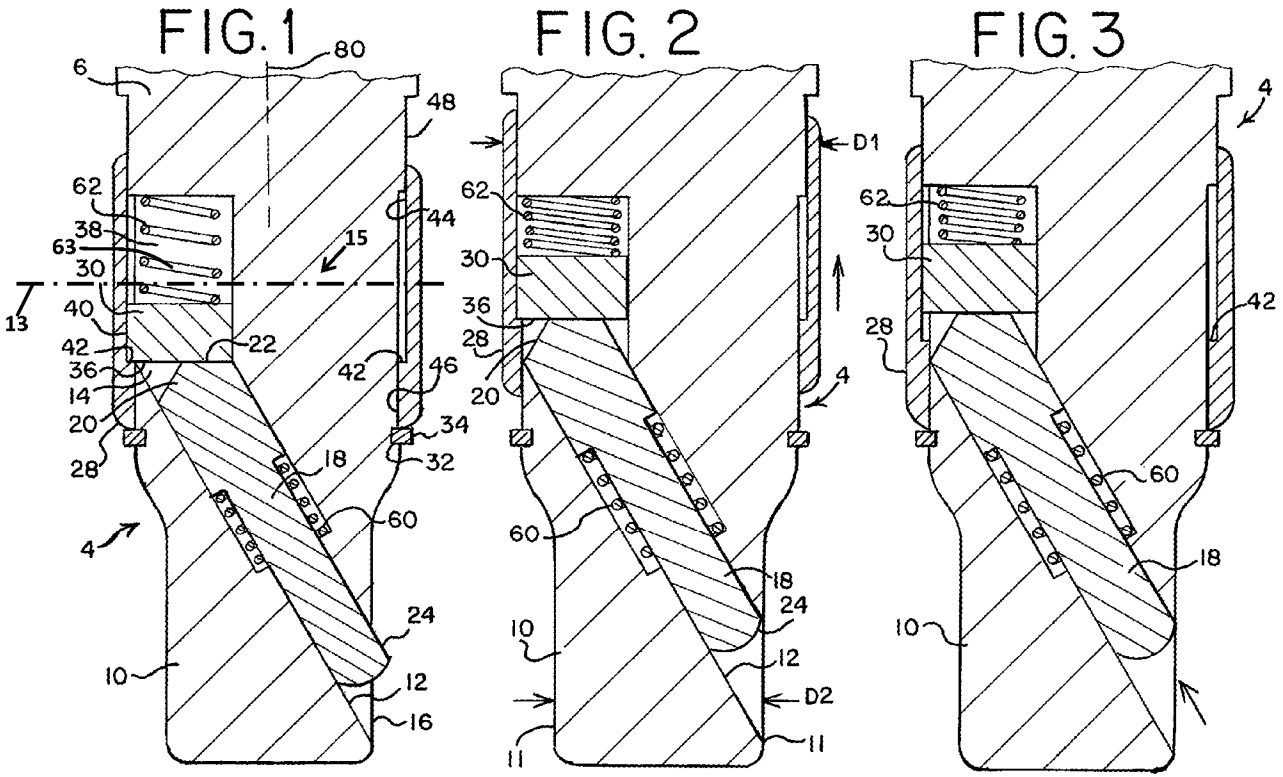
FIGS. 1, 2 and 3 are longitudinal sectional views of a tool that includes a first preferred embodiment of a mechanism for altering engagement forces, showing the mechanism in three different positions.

FIG. 1 shows a drive element 4 of a tool such as a hand, impact, or power tool. For example, the tool may be a wrench, ratchet, extension bar, universal joint, T-bar, breaker bar, speeder, or the like. The drive element is designed to engage and transmit torque to a tool attachment such as a socket (not shown). The drive element 4 includes an upper portion 6 and a drive stud 10. The drive stud 10 is configured for insertion into a tool attachment, and it typically defines an out-of-round cross-section. For example, the drive stud 10 may have a square, hexagonal or other non-circular shape in cross section. The upper portion 6 will often define a circular cross section, though this is not required. The drive element 4 includes a mechanism for altering engagement forces between the tool and a tool attachment, as described below.

In this example, a passageway 12 extends into the first portion 6 and the drive stud 10, and the passageway 12 is oriented at an oblique angle to a longitudinal axis 80 of the drive element 4. The passageway 12 includes an upper opening 14 and a lower opening 16, and the lower opening 16 is positioned at a portion of drive stud 10 configured for insertion into a tool attachment (not shown). As used throughout this specification and the following claims, the term "tool attachment" refers to any attachment configured to be engaged by the drive stud 10, including but not limited to sockets, universal joints, extension bars, certain ratchets, and the like.

The drive element 4 further includes an engaging element 18 moveably disposed in the passageway 12. The engaging element 18 of this example is formed in one piece, and it includes an upper portion 20 and a lower portion 24. As used throughout this specification and the following claims, the term "engaging element" refers to one or a plurality of coupled components, at least one of which is configured for releasably engaging a tool attachment. Thus, this term encompasses both single part engaging elements (e.g., element 18 in FIG. 1) and multi-part assemblies (e.g., the multiple part engaging elements shown in FIGS. 4-6, described below). The passageway 12 acts as a guide for the engaging element 18.

The primary function of the engaging element 18 is to hold a tool attachment on the drive stud 10 during normal use. The lower portion 24 of the engaging element 18 is configured to engage a tool attachment when the engaging element 18 is in an engaging position, and to relax and/or terminate engagement with the tool attachment when the engaging element 18 is in a releasing position. As used throughout this specification and the following claims, the term "engaging position" does not imply locking the tool attachment in place against all conceivable forces tending to dislodge the tool attachment.

Though illustrated as a cylindrically-symmetrical pin in FIG. 1, the engaging element 18 may take various shapes. If desired, the engaging element 18 may be provided with an out-of-round cross section and the passageway 12 may define a complementary shape such that a preferred rotational orientation of the engaging element 18 in the passageway 12 is automatically obtained (i.e., the engaging element need not be rotatable in the passageway 12). The terminus of the lower portion 24 of the engaging element 18 may be formed in any suitable shape and, for example, may be rounded as shown in U.S. Pat. No. 5,911,800, assigned to the assignee of the present invention.

The drive element 4 carries an actuating element which in this preferred embodiment includes a collar 28 and a guided element 30. The collar 28 slides longitudinally along a path that is essentially parallel to the length of the drive element 4. As shown in FIG. 1, the collar 28 may be held in place with a retaining element 34 such as a split ring or C-ring positioned in a corresponding groove 32 in the drive element 4. Any other retention member may be used that prevents separation of the collar 28 from the drive element 4. As illustrated in FIG. 1, the collar 28 is shown in an optional rest position, in which an end surface of the collar 28 rests on the retaining element 34.

The guided element 30 slides in a guide 38 in the drive element 4. For example, the guide 38 may be a milled channel in the drive element 4, and the guided element 30 may be received in the channel. In this example, the guide 38 is oriented parallel to the longitudinal axis 80. The guided element 30 defines a cam surface 36 at one end adjacent the engaging element 18, and the upper portion 20 of the engaging element 18 forms a cam surface 22 that slides across the cam surface 36 as the guided element 30 moves along the guide 38. In this example, the region of contact between the engaging element 18 and the cam surface 36 remains within the drive element 4 for all positions of the engaging element 18 and the guided element 30. This is not essential for all embodiments of the invention. See, for example the embodiment of FIG. 9. Also, the guided element 30 may be made shorter in the longitudinal direction to provide a longitudinally compact mechanism.

The guided element 30 can take many shapes, including, for example, circular, oval, hexagonal, and rectangular cross-sections. When a circular cross-section is used, the guided element 30 can be made rotationally symmetrical such that it is free to rotate in the drive element 4 as, for example, when the collar 28 is rotated on the drive element 4.

As shown in FIG. 1, the collar 28 includes a ledge 42 in at least a portion of an inner perimeter thereof. An outer portion 40 of the guided element 30 is positioned to contact the ledge 42, at least when the collar 28 is moved toward a releasing position. In this example, the ledge 42 extends completely around the inner perimeter of the collar 28, such that the collar 28 is freely rotatable around the longitudinal axis 80 with respect to drive element 4 and the guided element 30. In this embodiment, the outer portion 40 is substantially covered by the collar 28.

As shown in FIG. 1, the collar 28 extends around the outer circumferential periphery of the upper portion 6. It is to be understood that alternative structures, including but not limited to those that extend only partially around a circumference and those that have a short longitudinal length, may likewise be employed.

As shown in FIG. 1, the drive element 4 defines a step 48 which extends around the drive element 4. The collar 28 further includes first and second guide surfaces 44, 46, which center the collar 28 on the drive element 4 on both sides of the guided element 30. The guide surface 46 slides on a smaller-diameter surface of the drive element 4 on one side of the step 48, and the guide surface 44 slides on larger-diameter surface of the drive element 4 on the other side of the step 48. As shown in FIG. 1, the drive element 4 may be provided with a larger-diameter portion above the region reached by the collar in its uppermost position.

Tools embodying features of the present invention preferably include at least one biasing element that provides automatic engagement with a tool attachment once the tool has been assembled with the tool attachment. In some embodiments, such automatic engagement can operate after the exposed end of the engaging element is pushed to a releasing position by a tool attachment as the drive stud is inserted into the tool attachment. Automatic engagement can also be useful after the actuating element has been used to move the engaging element to a releasing position. In alternative embodiments in which engagement is to be manually initiated by an operator's movement of an actuating element, no biasing element may be required. In one alternative, a detent can be used to hold the actuating element in one or more positions, such as an engaging position and a releasing position.

The embodiment of FIG. 1 includes two biasing elements: a releasing spring 60 and an engaging spring 62. The releasing spring 60 bears on a shoulder of the engaging element 18 to bias the engaging element 18 toward the releasing position. The engaging spring 62 bears on the guided element 30 to bias the guided element 30 toward the engaging element 18. The spring force supplied by the engaging spring 62 is greater than that supplied by the releasing spring 60 such that, in the absence of externally- applied forces, forces from the engaging spring 62 hold the engaging element 18 in the engaging position shown in FIG. 1. The spring 62 includes a non-terminal portion 63 that lies in a plane 13 that is oriented perpendicular to the longitudinal axis 80 and that passes through a cross section 15 of the drive element 4. In alternate embodiments, a single spring may be used.

In this embodiment the springs 60,62 are compression-type coil springs, though many other types of biasing elements can be configured to perform the biasing functions described above. In alternate embodiments, the biasing elements may be implemented in other forms, placed in other positions, bias the engaging element and the actuating element in other directions, and/or be integrated with or coupled directly to other components.

FIGS. 1-3 show the illustrated mechanism in three separate positions. The position of FIG. 1 is the normal rest position, in which the engaging spring 62 overcomes the biasing force of the releasing spring 60 to hold the engaging element 18 in the engaging position.

As shown in FIG. 2, when external forces are applied to move the collar 28 in a direction away from drive stud 10, the collar 28 moves the guided element 30 away from the drive stud 10. This allows the lower portion 24 of the engaging element 18 to move out of or to be moved out of its engaging position (i.e., any position in which the terminus of the lower portion 24 projects outwardly from drive stud 10 sufficiently to engage the tool attachment) and further into the passageway 12.

When the collar 28 is allowed to move away from the position of FIG. 2, the biasing force of the engaging spring 62 again overcomes the biasing force of the releasing spring 60, thereby moving the guided element 30 toward the drive stud 10. This motion of the guided element 30 causes the cam surface 36 to move the engaging element 18 toward the position of FIG. 1.

As shown in FIG. 3, when the drive stud 10 is simply pushed into a tool attachment, the tool attachment can push the engaging element 18 into the drive stud 10, compressing the engaging spring 62 in the process. In this embodiment, the guided element 30 is able to move away from the drive stud 10 under the force of the engaging element 18 without moving the collar 28 away from the drive stud 10. In this way, a tool attachment can be placed on the drive element 4 without requiring movement of the collar 28.

If desired, an optional spring (not shown) may be provided to bias the collar 28 toward the drive stud 10, thereby holding the collar 28 in the position shown in FIG. 3 when the engaging element 18 is pushed into the passageway 12 by a tool attachment.

Because the region of contact between the engaging element 18 and the guided element 30 remains within the drive element 4, the collar 28 can be provided with an unusually small outer diameter for a given size of the drive stud 10.

In some embodiments, the guided element and the engaging element coupled thereto may be provided as physically unconnected pieces. In alternative embodiments, the guided element may be physically tethered to the engaging element, such as by a flexible connecting member similar to the flexible tension member 40 described in U.S. Pat. No. 5,214,986, the entire contents of which are incorporated herein by reference, except that in the event of any inconsistent disclosure or definition from the present application, the disclosure or definition herein shall be deemed to prevail. In these alternative embodiments, the flexible member may be provided as either a compression member, as a tension member, or both, such that a function of the flexible member may be to push and/or pull one or more parts tethered thereto.

Figure 6:
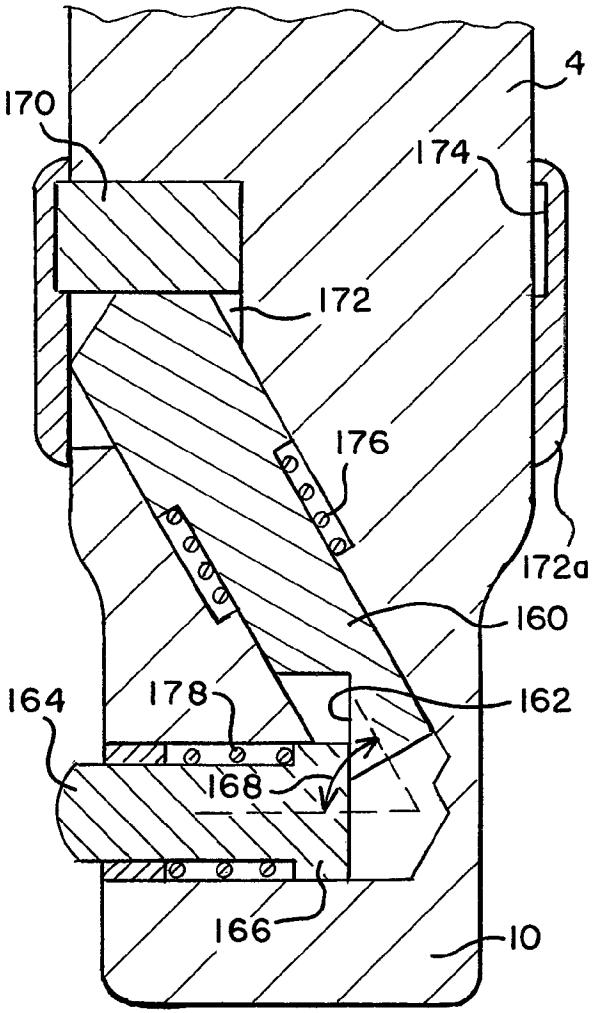
FIG. 6 is a longitudinal sectional view of a tool that includes a fourth preferred embodiment of a mechanism for altering engagement forces.
Figure 5:
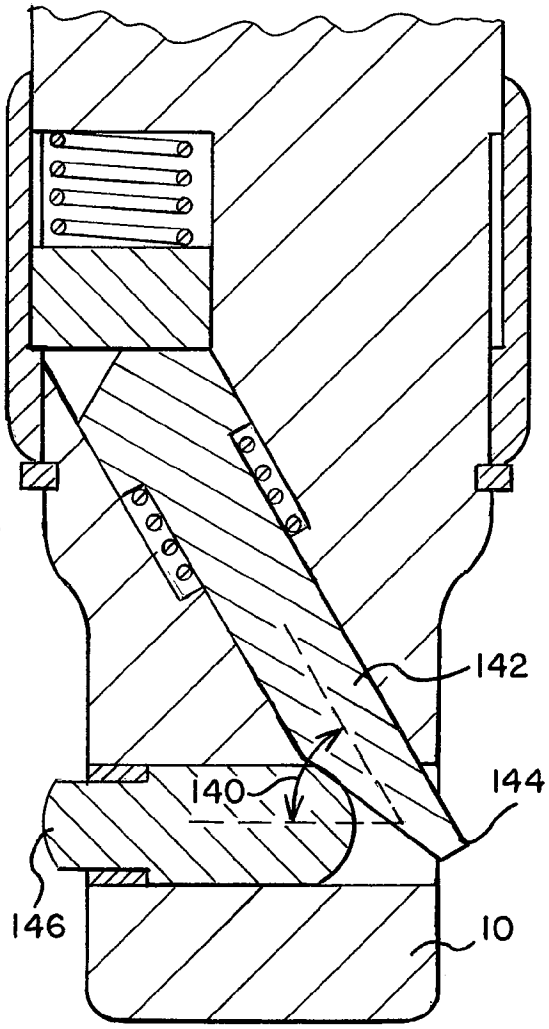
FIG. 5 is a longitudinal sectional view of a tool that includes a third preferred embodiment of a mechanism for altering engagement forces.
Figure 4:
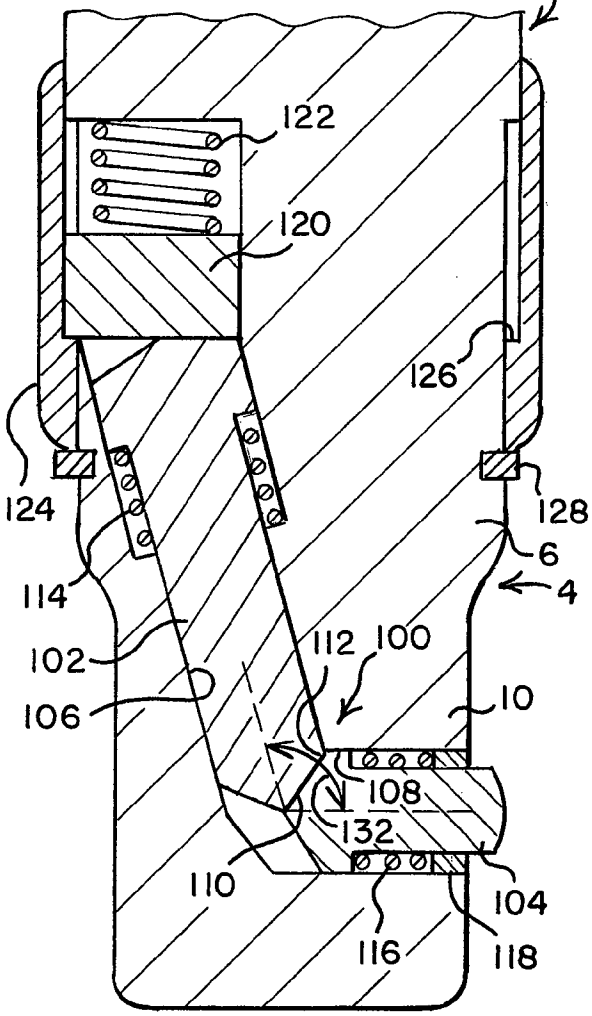
FIG. 4 is a longitudinal sectional view of a tool that includes a second preferred embodiment of a mechanism for altering engagement forces.

FIGS. 4, 5, and 6 illustrate preferred embodiments of the present invention that use a multiple-part engaging element. In these figures the reference symbols 4, 6, and 10 designate comparable parts to those described above in conjunction with FIG. 1. The drive element 4 of FIG. 4 carries a two-part engaging element 100 that includes a first part 102 and a second part 104. The first part 102 is guided by an oblique passageway that functions as a first guide 106, and this first guide 106 is oriented at an oblique angle with respect to the longitudinal axis of the tool. The tool also defines an additional guide 108 which in this embodiment is positioned transversely to the longitudinal axis. This additional guide 108 is also formed as a passageway, and the second part 104 is at least partially disposed in the additional guide 108. The first part 102 defines a cam surface 110 and the second part 104 defines a cam surface 112. A first releasing spring 114 biases the first part 102 upwardly, away from the drive stud 10, and a second releasing spring 116 biases the second part 104 into the drive stud 10. As illustrated, a retainer 118 can be press fit or otherwise mounted in the additional guide 108 to provide a reaction surface for the second releasing spring 116.

In alternative embodiments, the releasing spring 114 can be eliminated if the releasing spring 116 exerts sufficient forces biasing the first part 102 toward the guided element 120. Also, in other alternative embodiments, the spring 116 can be eliminated, as described below in conjunction with FIG. 5.

A guided element 120 biased by an engaging spring 122 is coupled to the first part 102 and these parts operate in a manner similar to the guided element 30 and the engaging spring 62 described above in conjunction with FIG. 1. The guided element 120 is at least at some times coupled to a collar 124 that defines a ledge 126. The collar 124 is held in place on the tool by a retainer 128, and the outer surface of the drive element 4 guides the longitudinal and rotational movement of the collar 124.

FIG. 4 shows the illustrated mechanism in the rest position, in which the biasing force of the engaging spring 122 overcomes the biasing forces of the releasing springs 114, 116 to move the first part 102 to the position shown in FIG. 4. In this position, the cam surface 110 of the first part 102 holds the second part 104 in a tool attachment engaging position, in which a protruding end of the second part 104 is positioned to engage a recess or bore in the socket of a tool attachment (not shown).

When an operator wishes to release a tool attachment, the collar 124 is moved away from the drive stud 10, thereby compressing the engaging spring 122. The releasing springs 114, 116 then move the first part 102 upwardly and the second part 104 inwardly, such that the protruding end of the second part 104 moves toward the drive stud 10. In this way a tool attachment is released.

In this embodiment, the second part 104 defines a generally cylindrical portion designed to provide a positive interlock with a complementary opening in a tool attachment. This provides a particularly secure and reliable engagement with the tool attachment.

The reference symbol 132 is used to designate an included angle between the first guide 106 and the additional guide 108. In this embodiment, the included angle is greater than 90°, as illustrated.

The mechanism of FIG. 5 also includes a multiple-part engaging element, and there are three primary differences between the mechanisms of FIGS. 4 and 5. First, the included angle 140 in this embodiment is less than 90°. Second, in this embodiment the first part 142 is provided with an end 144 that is positioned to extend out of the drive stud 10 when the first part 142 is in the engaging position shown in FIG. 5. This arrangement engages a tool attachment on two opposite sides of the drive stud 10. On one side (to the left as shown in FIG. 5) the second part 146 is moved into a complementary opening in the side wall of the tool attachment. On the other side (to the right as shown in FIG. 5) the end 144 of the first part 142 presses against the tool attachment to wedge the drive stud 10 in the tool attachment. Third, in this embodiment the second part 142 is not provided with a biasing element. This embodiment is designed for applications that require the operator to manually move the second part 142 into the drive stud (as for example with a pin or the like) in order to release a tool attachment.

If desired, the end 144 may be configured to remain within the drive stud 10 for all positions of the mechanism. If this is done, the face of the drive stud near the end 144 may remain solid, without any through openings.

The embodiment of FIG. 6 illustrates another multiple-part engaging element, including a first part 160 that defines a cam surface 162 oriented as illustrated, and a second part 164 that defines a cam surface 166 positioned to slide along the cam surface 162. In this embodiment the included angle 168 between the guides for the first and second parts 160, 164 is less than 90°. Additionally, the embodiment of FIG. 6 includes a guided element 170 that slides in a guide 172 formed in the drive element 4. As in FIGS. 1-5, the guide 172 in this embodiment is formed as a milled slot in the body of the drive element 4. As shown in FIG. 6, a collar 172 is mounted for longitudinal and rotational movement on the drive element 4. In this example, the collar 172 defines an annular recess 174 that receives an outer portion of the guided element 170. Though many alternatives are possible, no spring is provided in this embodiment between the guided element 170 and the drive element 4, and no relative longitudinal movement is allowed in this embodiment between in the guided element 170 and the collar 172.

In the absence of applied forces, the spring 176 compresses the spring 178 and biases the second part 164 to the position shown in FIG. 6, in which the second part 164 protrudes out of the drive stud 10 to engage a tool attachment (not shown). To release a tool attachment, the collar 172 is moved longitudinally along the tool toward the drive stud 10, thereby compressing the spring 176 and moving the cam surface 162 toward the right as shown in FIG. 6. This allows the spring 178 to move the second part 164 to the right as shown in FIG. 6, thereby releasing a tool attachment. When external forces are removed from the collar 172, the spring 176 overrides the spring 178 and returns the mechanism to the position shown in FIG. 6.

Figure 7:
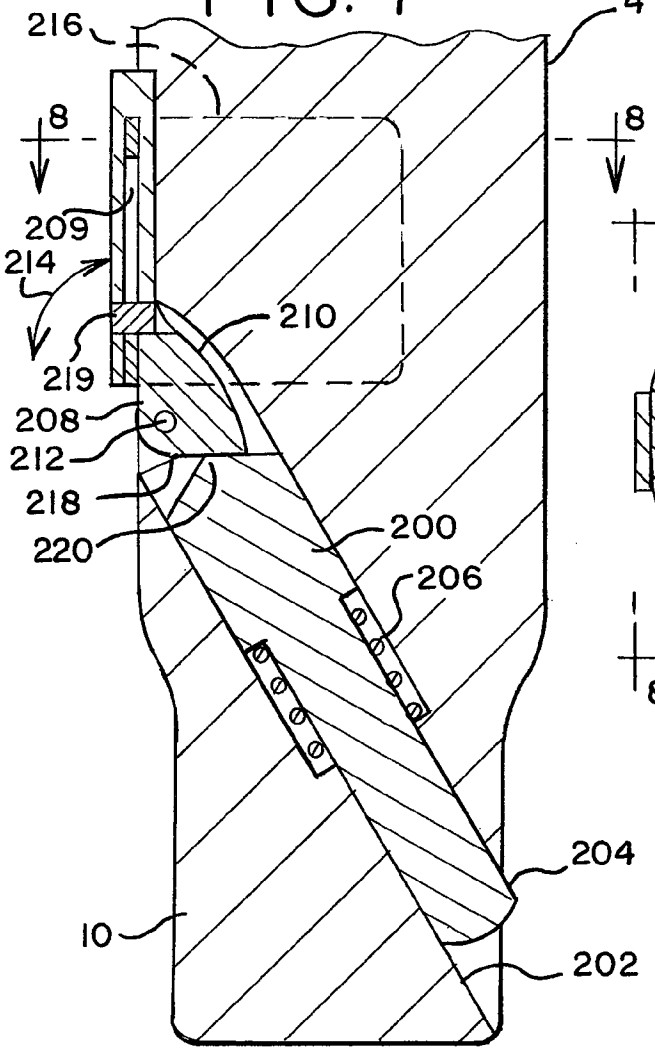
FIG. 7 is a longitudinal sectional view of a tool that includes a fifth preferred embodiment of a mechanism for altering engagement forces.

The embodiment of FIG. 7 includes an engaging element 200 mounted to slide in a passageway 202 that is oriented at an oblique angle with respect to the longitudinal axis of the tool. The engaging element 202 defines a lower end 204 configured to extend out of the passageway 202 in the region of the drive stud 10 to engage a tool attachment. The engaging element 200 is biased to a releasing position by a spring 206

The position of the engaging element 200 is controlled by an actuating element 208 that is pivotably mounted within a recess 210 in the drive element 4. The actuating element 208 is held in the recess 210 by a pin 212. The recess 210 operates as a guide that guides the actuating element 208 for relative movement with respect to the drive element 4 along the direction shown by the arrow 214. This relative movement includes components of motion extending parallel to the longitudinal axis of the tool. A retainer 216 is mounted to one end of the actuating element 208 to releasably retain the actuating element 208 in the position shown in FIG. 7. In some forms of the embodiment of FIG. 7, the pin 212 may play a large role in guiding movement of the actuating element 208, and the recess 210 will still be referred to as a guide for the actuating element.

Figure 8A:
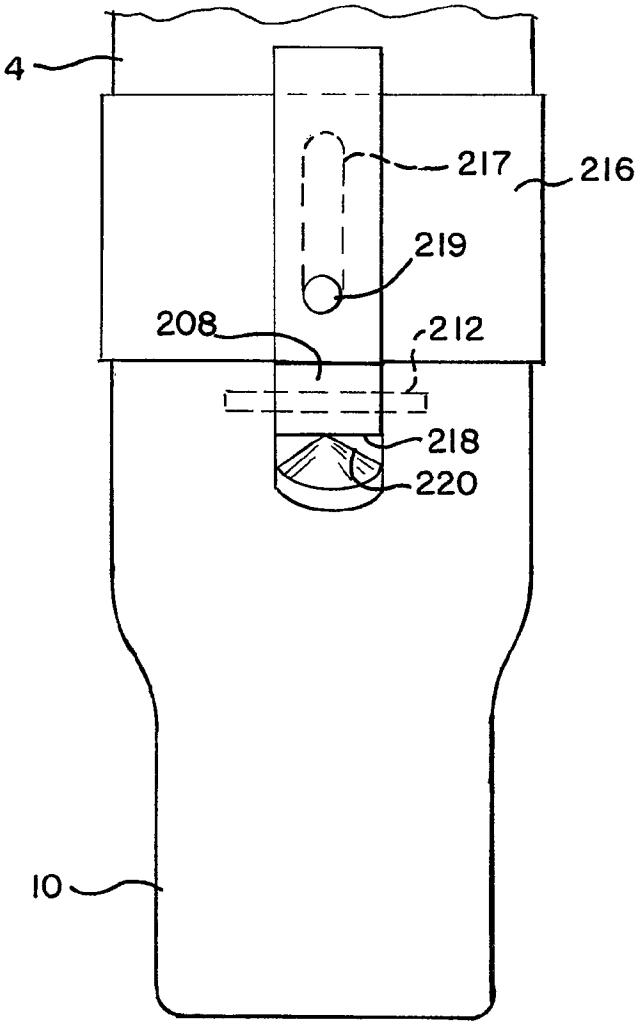
FIG. 8*a* is an elevational view taken along line 8*a*-8*a* of FIG. 8.
Figure 8:
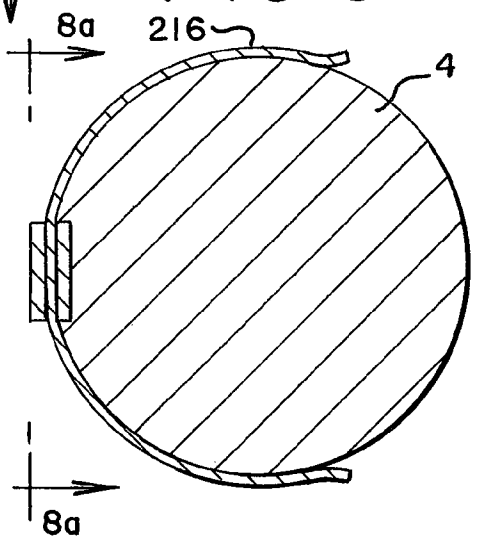
FIG. 8 is a cross-sectional view taken along line 8-8 of FIG. 7.

FIG. 8 is a transverse sectional view that illustrates how the retainer 216 extends partially around the body of the drive element 4. The retainer 216 is formed of spring steel and when snapped into the position shown in FIG. 8 holds the actuating element 208 in the recess 210. In this position the actuating element 208 holds the engaging element 200 in the tool attachment engaging position shown in FIG. 7.

The end of the actuating element 208 facing the drive stud 10 defines a cam surface 218, and the upper end of the engaging element 200 defines a cam surface 220. When the actuating element 208 is rotated in a counterclockwise sense in the direction of the arrow 214, the cam surface 220 slides along the cam surface 218 as the spring 206 moves the engaging element 200 upwardly. This allows the exposed end 204 of the engaging element 200 to move toward the passageway 202, thereby releasing any tool attachment on the drive stud 10.

When it is desired to engage a tool attachment, the drive stud 10 is inserted into the tool attachment (with the exposed end of the engaging element 200 positioned within the drive stud 10). Then the actuating element 208 is moved more deeply into the recess 210, thereby moving the engaging element 200 to the position shown in FIG. 7.

FIGS. 7 and 8*a* show the connection between the actuating element 208 and the retainer 216. The actuating element 208 defines a slot 209, and the retainer 216 is mounted to slide in the slot 209. The retainer 216 is captured in the slot 209 by a pin 219, and the pin 219 passes through a second slot 217 in the retainer 216. This second slot 217 limits the range of motion of the retainer 216 in the actuating element 208. FIG. 8*a* shows the retainer 216 in the uppermost position, in which the retainer 216 is positioned to allow the actuating element to be rotated counterclockwise in the view of FIG. 7 to release a tool attachment. When the mechanism is in the position shown in FIGS. 7 and 8*a*, the retainer can be moved along the drive element 4 toward the drive stud 10 until the lower portion of the retainer 216 is positioned to cover the cam surfaces 218, 220. In this position, the retainer both protects the mechanism from foreign objects and prevents the actuating element from moving to allow the engaging element to release a tool attachment. Any such attempted movement of the actuating element is blocked by the lower edge of the retainer 216, because such attempted movement forces the lower edge of the retainer 216 against the outer surface of the drive element 4 below the pin 212.

Figure 9:
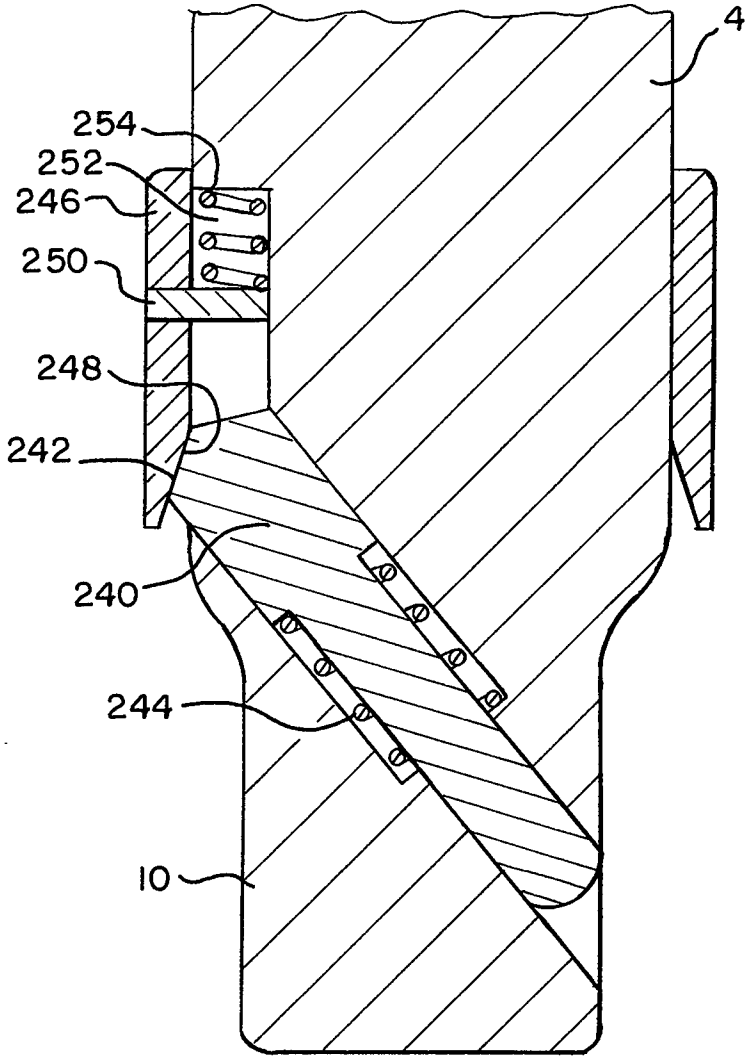
FIG. 9 is a longitudinal sectional view of a tool that includes a sixth preferred embodiment of a mechanism for altering engagement forces.

FIG. 9 shows another embodiment in which an engaging element 240 is provided with a cam surface 242 that is generally conical. Other shapes can be used for the cam surface 242, which can be formed by a rounded or curved end of the engaging element 240, or by a wedge-shaped end of the engaging element 240. Alternatively, the cam surface 242 may provide line contact between the engaging element 240 and the actuating element 208. The engaging element 240 is biased to a releasing position as shown in FIG. 9 by a biasing element 244.

The position of the engaging element 240 is controlled by an actuating element 246 that in this embodiment includes an annular collar. The actuating element 246 includes a cam surface 248 configured to engage the cam surface 242. The actuating element 246 is guided for longitudinal motion along the body of the drive element 4 by a pin 250 that slides in a channel 252 formed in the drive element 4, and the pin 250 is biased toward the drive stud 10 by an engaging spring 254. The engaging spring 254 has a sufficiently large spring force to compress the biasing element 244 in the absence of applied forces on the actuating element 246. As the engaging spring 254 moves the actuating element 246 toward the drive stud 10, the cam surface 248 moves the engaging element 240 to compress the biasing element 244. This causes the lower end of the engaging element 240 to extend out of the drive stud 10, thereby engaging a tool attachment in the rest position of the mechanism.

FIG. 9 shows the mechanism with the actuating element 246 moved away from the drive stud 10 and the engaging element 240 in a release position, as is the case when external forces move the actuating element 246 to compress the spring 254. In this embodiment, the actuating element is guided by the channel 252, and the actuating element 246 is prevented from rotating on the drive element 4. If desired, the actuating element 246 and the pin 250 can be formed in one piece. In alternative embodiments, the actuating element 246 and the pin 250 can be configured to allow the actuating element 246 to rotate around the drive element 4, as described above in conjunction with FIGS. 1 and 6. As another alternative, the pin 250 may be positioned to contact the upper end of the engaging element 240, in addition to or instead of the cam surface 248. Also, the collar may extend only partially over the cam surface 242 when positioned as shown in FIG. 9.

Figure 10:
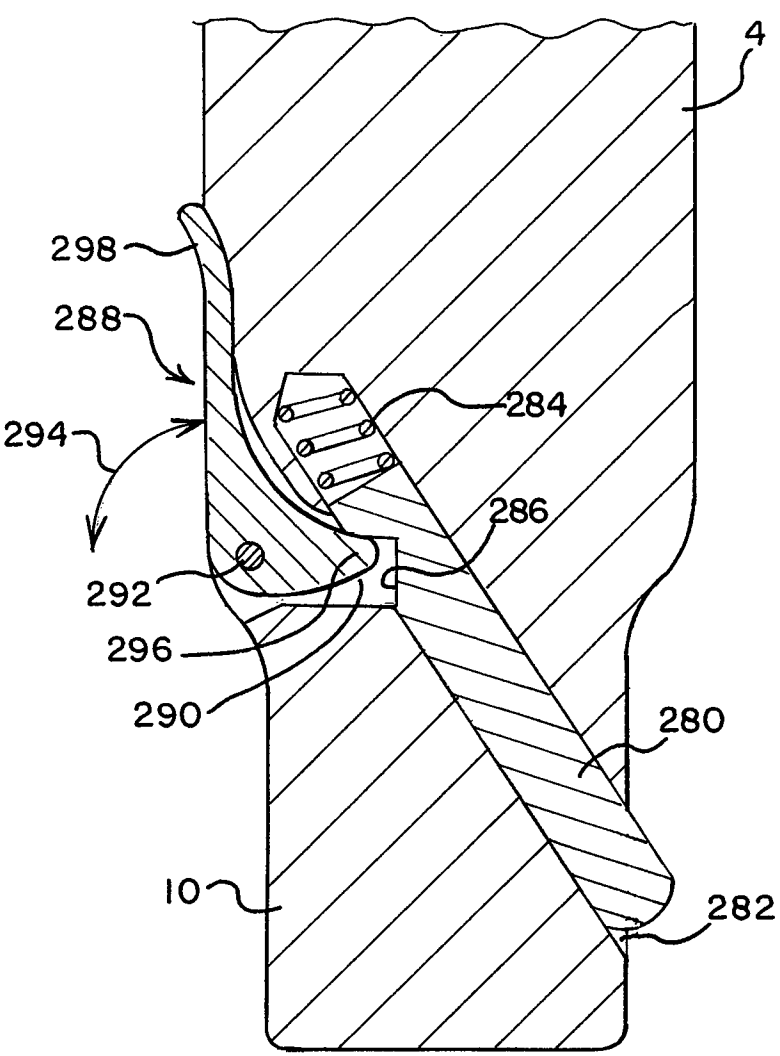
FIG. 10 is a longitudinal sectional view of a tool that includes a seventh preferred embodiment of a mechanism for altering engagement forces.

The embodiment of FIG. 10 is in some ways similar to that of FIG. 7 in that it includes a pivotable actuating element. As shown in FIG. 10, an engaging element 280 is guided in a passageway 282 for movement at an oblique angle with respect to a longitudinal axis of a drive element 4. In this case, the passageway 282 is formed as a blind bore that does not pass completely through the drive element 4, and a spring 284 biases the engaging element 280 to an engaging position as shown in FIG. 10. The engaging element 280 includes a groove 286 extending at least partially around the periphery of the engaging element. In this embodiment, the groove extends only on one side of the engaging element 280, though if the groove is sufficiently shallow the groove may extend completely around the engaging element and the engaging element 280 can be free to rotate in the passageway.

An actuating element 288 is received at least partially in a recess 290 in the drive element 4. This recess 290 acts as a guide for the actuating element 288, and the recess 290 intersects the passageway 282. The actuating element 288 is held in an assembled relationship with the drive element 4 by a pin 292, such that the actuating element 288 pivots in the direction indicated by the arrow 294.

A first end 296 of the actuating element 288 is received in the groove 284, and a second end 298 of the actuating element 288 extends away from the drive stud 10. The second end 298 is shaped to allow a user to move the second end 298 to the left as shown in FIG. 10, thereby moving the engaging element 280 to compress the spring 284. In this way, the user can move the engaging element 280 to a releasing position to release a tool attachment from the drive stud 10. When externally-applied forces are removed from the actuating element 288, the spring 284 biases the engaging element 280 and the actuating element 288 back to the positions shown in FIG. 10.

The embodiments described above all provide the advantage that the actuating element can be sized to extend only a small distance beyond the drive element. When the actuating element includes a collar, and the drive stud includes two opposed faces, the ratio of the maximum outside diameter D1 of the collar to the face-to-face separation D2 between the two opposed faces is a measure of the extent to which the collar protrudes. FIG. 2 shows one example of how to measure D1 and D2, where two opposed faces of the drive stud 10 are indicated by the reference number 11. Of course, similar measurements can be made with the other illustrated embodiments that include a collar.

In various applications, the ratio D1/D2 can be made to equal a wide range of desired values, including those listed in the following table (all dimensions in inches):

| D1 | D2 | D1/D2 |
|---|---|---|
| .510 | .375 | 1.360 |
| .520 | .375 | 1.387 |
| .530 | .375 | 1.413 |
| .540 | .375 | 1.440 |

-continued

| D1 | D2 | D1/D2 |
|---|---|---|
| .550 | .375 | 1.467 |
| .560 | .375 | 1.493 |
| .570 | .375 | 1.520 |
| .580 | .375 | 1.547 |
| .590 | .375 | 1.573 |
| .600 | .375 | 1.600 |
| .610 | .375 | 1.627 |
| .620 | .375 | 1.653 |
| .630 | .375 | 1.680 |
| .640 | .375 | 1.707 |
| .650 | .375 | 1.733 |
| .660 | .375 | 1.760 |
| .670 | .375 | 1.787 |
| .680 | .375 | 1.813 |
| .690 | .375 | 1.840 |
| .700 | .375 | 1.867 |
| .710 | .375 | 1.893 |

The foregoing table provides examples of collar dimensions for a ⅜ inch drive size, but it should be understood that collars for drive elements of other drive sizes can be provided with similar ratios of D1/D2. Also, even smaller ratios D1/D2 can be provided with this invention.

Throughout this description and in the appended claims, the following definitions are to be understood:

The term "coupled" and various forms thereof are intended broadly to encompass both direct and indirect coupling. Thus, a first part is said to be coupled to a second part when the two parts are directly coupled (e.g. by direct contact or direct functional engagement), as well as when the first part is functionally engaged with an intermediate part which is in turn functionally engaged either directly or via one or more additional intermediate parts with the second part. Also, two parts are said to be coupled when they are functionally engaged (directly or indirectly) at some times and not functionally engaged at other times.

The term "engage" and various forms thereof, when used with reference to retention of a tool attachment, refer to the application of any forces that tend to hold a tool and a tool attachment together against inadvertent or undesired separating forces (e.g., such as may be introduced during use of the tool). It is to be understood, however, that engagement does not in all cases require an interlocking connection that is maintained against every conceivable type or magnitude of separating force.

The designations "upper" and "lower" used in reference to elements shown in the drawings are applied merely for convenience of description. These designations are not to be construed as absolute or limiting and may be reversed. For the sake of clarity, unless otherwise noted, the term "upper" generally refers to the side of an element that is farther from a coupling end such as a drive stud. In addition, unless otherwise noted, the term "lower" generally refers to the side of an element that is closer to the coupling end.

The term "longitudinal" refers to directions that are generally parallel to the length direction of the drive element. In the embodiments described above, the longitudinal direction is generally parallel to the longitudinal axis 80.

The term "element" includes both single-part components and multiple-part components. Thus, an element may be made up of two or more separate components that cooperate to perform the function of the element.

As used herein, movement of an element toward a position (e.g., engaging or releasing) or toward a particular component (e.g., toward or away from a drive stud) includes all manner of longitudinal motions, skewed motions, rotational motions, and combinations thereof.

The term "relative movement" as applied to translation between two parts refers to any movement whereby the center of mass of one part moves in relation to the center of mass of another part.

The term "cam surface" refers broadly to a surface that is shaped such that relative movement in a first direction between the cam surface and a second element in contact with the surface can cause the second element to move relatively in a second direction, different from the first direction. Cam surfaces may be of various types and shapes, including, without limitation, translating cam surfaces, rotating cam surfaces, and cam surfaces that both translate and rotate.

As used herein, the term "biasing element" refers to any device that provides a biasing force. Representative biasing elements include but are not limited to springs (e.g., elastomeric or metal springs, torsion springs, coil springs, leaf springs, tension springs, compression springs, extension springs, spiral springs, volute springs, flat springs, and the like), detents (e.g., spring-loaded detent balls, cones, wedges, cylinders, and the like), pneumatic devices, hydraulic devices, and the like, and combinations thereof.

The tools described above are characterized in varying degrees by some or all of the following features: simple construction; a small number of easily manufactured parts; easy access to an operator using the tool in a tight and/or restricted workspace; rugged, durable, and reliable construction; an ability to accommodate various tool attachments, including those with various sizes and configurations of recesses designed to receive a detent; self adjusting for wear; substantially eliminating any precise alignment requirements; readily cleanable; presenting a minimum of snagging surfaces; extending outwardly from the tool by a small amount; and having a short longitudinal length.

The mechanisms illustrated in the drawings include actuating elements that have a maximum cross-sectional dimension that is only slightly larger that that of the drive elements on which they are mounted. Such an actuating element brings several advantages. Since the actuating element has a small outside diameter, the resulting tool is compact and easily used in tight spaces. Also, the actuating element is less subject to being accidentally moved to the releasing position during use, because it presents a smaller cross-section than many tool attachments.

Of course, it should be understood that a wide range of changes and modifications can be made to the preferred embodiments described above. For example, the multiple-part engaging elements of FIGS. 4-6 can be used with the widest variety of actuating elements and biasing elements, including appropriate ones of the actuating elements and biasing elements shown in the other figures. Similarly, the illustrated actuating elements can be used with a wide variety of engaging elements. In general, features can be selected from two or more of the embodiments described above and combined to produce many additional embodiments of the invention. Also, for convenience various positions of the cam surfaces, the engaging elements and the actuating elements have been described. It will of course be understood that the term "position" is intended to encompass a range of positions, as is appropriate for tool attachments that have recesses and bores of varying shapes and dimensions.

It is therefore intended that the foregoing detailed description be regarded as illustrative rather than limiting, and that it be understood that it is the following claims, including all equivalents, which are intended to define the scope of this invention.

We claim:

1. A tool for detachably engaging a tool attachment and for rotating the tool attachment about a rotational axis, said tool comprising:

a drive element comprising first and second portions that meet at a transition with the first and second portions defining the rotational axis, wherein the first portion is configured for insertion in the tool attachment and the second portion is configured to remain outside the tool attachment; and a mechanism for altering engagement forces between the tool attachment and the drive element, said mechanism comprising:

an engaging element that engages the tool attachment, wherein the engaging element is moveable within a bore provided in the drive element and oriented at an acute angle to the rotational axis;

an actuating element coupled to the engaging element for permitting modification of the engagement forces of an attached tool attachment;

a biasing element that is disposed at least partially within a guide that is provided in the drive element and situated entirely on one side of the rotational axis and that applies a biasing force at the engaging element to bias the engaging element along a path toward engagement with the tool attachment, wherein the biasing force at the engaging element is oriented at a non-zero angle with respect to the path, said biasing element comprising a non-terminal portion situated external to the drive element;

wherein the drive element includes a first cross-section that lies in a plane oriented perpendicular to the rotational axis and that at least in part extends farther from the rotational axis than does said non-terminal portion of the biasing element that lies in the plane.

2. The invention of claim 1 wherein said biasing element at least in part moves along an external surface of the drive element as the engaging element moves to engage the tool attachment.

3. The invention of claim 1 wherein the biasing element comprises a coil spring having an outer diameter and an outermost surface, wherein the outermost surface of the coil spring is substantially cylindrical in shape with a cylinder diameter equal to the outer diameter.

4. The invention of claim 1, wherein the engaging element moves along a direction oriented at an oblique angle with respect to the rotational axis of the drive element.

5. The invention of claim 1, wherein the biasing element contacts the drive element at a largest radial periphery of the biasing element.

6. The invention of claim 1, wherein the biasing element is laterally offset with respect to the rotational axis of the drive element.

7. The invention of claim 1, wherein the drive element further comprises a first portion for insertion into a tool attachment and a second portion that remains outside the tool attachment.

8. The invention of claim 1 wherein the biasing element applies a force at the engaging element that is at an oblique angle with respect to the path.

9. The invention of claim 1 wherein the actuating element is externally accessible.

10. The invention of claim 1 wherein the actuating element is located at a radial distance from the rotational axis that is farther than the engaging element.

11. The invention of claim 1 wherein the actuating element extends adjacent the second portion of the drive element and spaced from the tool attachment along the rotational axis.

12. The invention of claim 1 wherein the biasing element is oriented substantially parallel to the rotational axis.

13. The invention of claim 1 wherein the actuating element comprises a guided element contacted by the biasing element such that the guided element moves the engaging element toward engagement.

14. A tool for detachably engaging a tool attachment, said tool comprising:

a drive element defining a longitudinal axis and comprising first and second portions that meet at a transition, said first portion configured for insertion in the tool attachment and said second portion configured to remain outside the tool attachment; and a mechanism for altering engagement forces between the tool attachment and the drive element, said mechanism comprising:

an engaging element at least in part movable with respect to the drive element in a first direction, said engaging element comprising an engaging portion to selectively engage the tool attachment; and an actuating element at least in part movable with respect to the drive element along a second direction, said actuating element coupled to the engaging element for permitting modification of the engagement forces of an attached tool attachment;

a biasing element disposed at least partially within a guide that is provided in the drive element and situated entirely on one side of the longitudinal axis and biasing the engaging element along a path toward engagement with the tool attachment, wherein the biasing element applies a force at the engaging element that is at a non-zero angle with respect to the path;

wherein the actuating element is coupled to the engaging element at a region positioned at least partially within a channel formed in the second portion such that said region and an outermost part of the drive element are intersected by a plane oriented perpendicular to the longitudinal axis, wherein said region extends closer to the longitudinal axis than does said outermost part of the drive element measured in said plane oriented perpendicular to the longitudinal axis.

15. The invention of claim 14 wherein the second direction is more nearly parallel to the longitudinal axis than is the first direction.

16. The invention of claim 14 wherein the engaging element moves along the first direction oriented at an oblique angle with respect to the longitudinal axis.

17. The invention of claim 14 wherein the biasing element is oriented substantially parallel to the longitudinal axis.

18. The invention of claim 14 wherein the actuating element comprises a guided element contacted by the biasing element such that the guided element moves the engaging element toward engagement.

19. The invention of claim 1 or 14 wherein the mechanism for altering engagement forces further comprises an additional biasing element operative to bias the engaging element away from engagement with the tool attachment.

20. The invention of claim 1 or 14 wherein said actuating element comprises a guided element that is movable with respect to the drive element.

21. The invention of claim 20 wherein the guided element comprises a cam surface, and wherein the engaging element is positioned to slide across the cam surface as the guided element moves.

22. The invention of claim 21 wherein the cam surface is positioned to contact the engaging element within the drive element as the guided element moves.

23. The invention of claim 20 wherein said actuating element comprises a collar.

24. The invention of claim 23 wherein said collar is coupled to the guided element for rotation with respect to the guided element and the drive element.

25. The invention of claim 23 wherein said collar is coupled to the guided element such that the collar moves the guided element away from the first portion when the collar is moved away from the first portion.

26. The invention of claim 25 wherein the collar is coupled to the guided element such that the guided element is free to move away from the first portion without moving the collar away from the first portion.

* * * * *